US009151529B2

(12) United States Patent
Bertolini et al.

(10) Patent No.: US 9,151,529 B2
(45) Date of Patent: Oct. 6, 2015

(54) REFRIGERATOR/FREEZER ICE BUCKET

(71) Applicant: Electrolux Home Products, Inc., Charlotte, NC (US)

(72) Inventors: Nilton Carlos Bertolini, Chonburi (TH); Justin Morgan, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 283 days.

(21) Appl. No.: 13/932,538

(22) Filed: Jul. 1, 2013

(65) Prior Publication Data

US 2015/0000326 A1 Jan. 1, 2015

(51) Int. Cl.
*F25C 5/18* (2006.01)

(52) U.S. Cl.
CPC ..... *F25C 5/182* (2013.01)

(58) Field of Classification Search
CPC ..... F25C 5/182
See application file for complete search history.

(56) References Cited

U.S. PATENT DOCUMENTS

| | | | | |
|---|---|---|---|---|
| 3,436,928 | A * | 4/1969 | Swerbinsky | 62/137 |
| 5,715,962 | A | 2/1998 | McDonnell et al. | |
| 7,726,753 | B2 | 6/2010 | Bassi et al. | |
| 2009/0205358 | A1 | 8/2009 | Smith | |
| 2010/0043478 | A1 * | 2/2010 | Kim | 62/344 |
| 2010/0058796 | A1 * | 3/2010 | Kim | 62/344 |
| 2011/0138821 | A1 | 6/2011 | Chase et al. | |
| 2011/0138842 | A1 | 6/2011 | Chase et al. | |

* cited by examiner

*Primary Examiner* — Emmanuel Duke
(74) *Attorney, Agent, or Firm* — Pearne & Gordon LLP

(57) ABSTRACT

A refrigerator/freezer ice bucket is provided. The ice bucket may include a dispenser interface configured to deliver ice cubes to an ice dispenser upon a request by a user for the ice cubes. The dispenser interface may include a back wall. The ice bucket may further include storage configured to, with the back wall of the dispenser interface, store the ice cubes until the user request. The storage includes a fixed portion and a hinged outer wall. The hinged outer wall is configured to pivot from a position that is parallel to an opposite wall of the fixed portion to a position in which one or more portions of the hinged outer wall are fixed to be slanted upwardly away from the opposite wall of the fixed portion, thereby expanding a capacity of the storage.

20 Claims, 14 Drawing Sheets

REFRIGERATOR/FREEZER ICE BUCKET

BACKGROUND

1. Field

The following description relates to a refrigerator/freezer ice bucket.

2. Description of Related Art

A conventional ice bucket for a refrigerator/freezer unit is a plastic bin that is used to store ice cubes. If an icemaker is included in the refrigerator/freezer unit, the ice bucket may be placed underneath the icemaker to collect ice cubes made by the icemaker. The ice cubes made can be preserved in the ice bucket until being retrieved by a user of the refrigerator/freezer unit.

If an ice dispenser is included in the refrigerator/freezer unit, the ice bucket may be machined to accept an auger provided by the ice dispenser. The auger may force ice cubes stored in the ice bucket to the ice dispenser when the user makes a request for ice cubes via the ice dispenser. A spring hinge or the like can be used by the icemaker to detect a volume of ice cubes within the ice bucket in order to inhibit the icemaker from making more ice cubes than can be contained by the ice bucket.

The plastic bin serving as the conventional ice bucket for an icemaker and an ice dispenser is machined to accept a certain, nonadjustable volume of ice cubes and an auger to force the ice cubes from the ice bucket to the ice dispenser when a request for ice cubes is made by a user. While the user typically desires a large ice bucket so a large amount of ice cubes can be stored therein, a large ice bucket may have an adverse effect on available space inside the refrigerator/freezer unit for storage of other items. Further, while the user typically desires a large amount of available storage space for other items inside the refrigerator/freezer unit, a smaller ice bucket may be inconvenient for the maintenance of a large amount of ice cubes for occasions such as parties, hosting guests, cooler use during long trips, or the like.

SUMMARY

In one general aspect, a refrigerator/freezer ice bucket may include a dispenser interface configured to deliver ice cubes to an ice dispenser upon a request by a user for the ice cubes. The dispenser interface may include a back wall. The ice bucket may further include storage configured to, with the back wall of the dispenser interface, store the ice cubes until the user request. The storage includes a fixed portion and a hinged outer wall. The hinged outer wall is configured to pivot from a position that is parallel to an opposite wall of the fixed portion to a position in which one or more portions of the hinged outer wall are fixed to be slanted upwardly away from the opposite wall of the fixed portion, thereby expanding a capacity of the storage.

The hinged outer wall may include a lower adjustable portion hinged to the fixed portion and an upper adjustable portion hinged to the lower adjustable portion.

The lower adjustable portion may be configured to pivot from a position that is parallel to the opposite wall of the fixed portion to a position that is slanted upwardly away from the opposite wall of the fixed portion.

The upper adjustable portion may be configured to remain in a position that is parallel to the opposite wall of the fixed portion during a pivoting of the lower adjustable portion.

The fixed portion may include a bottom floor disposed adjacent to the opposite wall of the fixed portion. One or more portions of the bottom floor may be perpendicular to the opposite wall of the fixed portion. The portions of the hinged outer wall configured to slant upwardly away from the opposite wall of the fixed portion may include a lower adjustable portion hinged to the bottom floor of the fixed portion. The bottom floor may be disposed between the lower adjustable portion and the opposite wall of the fixed portion.

The hinged outer wall may further include an upper adjustable portion hinged to the lower adjustable portion. The upper adjustable portion may be parallel to the opposite wall of the fixed portion and perpendicular to the portions of the bottom floor that are perpendicular to the opposite wall of the fixed portion.

The lower adjustable portion may be configured to pivot from a position that is parallel to the opposite wall of the fixed portion and perpendicular to the portions of the bottom floor that are perpendicular to the opposite wall of the fixed portion to a position that is slanted upwardly away from the opposite wall of the fixed portion and the portions of the bottom floor that are perpendicular to the opposite wall of the fixed portion.

The hinged outer wall may include an upper adjustable portion hinged to the lower adjustable portion. The upper adjustable portion may be parallel to the opposite wall of the fixed portion and perpendicular to the portions of the bottom floor that are perpendicular to the opposite wall of the fixed portion. The upper adjustable portion may be configured to remain parallel to the opposite wall of the fixed portion and perpendicular to the portions of the bottom floor that are perpendicular to the opposite wall of the fixed portion during the pivoting of the lower adjustable portion and a corresponding pivoting of the upper adjustable portion.

The lower adjustable portion may include a wall portion and a pair of wings disposed on opposite sides of the wall portion. Each of the wings may include a slot. The back wall of the dispenser interface may include a slot facing the storage. The fixed portion may include a slot facing the storage on a wall of the fixed portion that is opposite the back wall of the dispenser interface. The upper adjustable portion may include a plurality of posts. The slots may be configured to respectively receive the posts and allow the posts to move therein, thereby serving to pivot the lower adjustable portion from the position that is parallel to the opposite wall of the fixed portion to the position that is slanted upwardly away from the opposite wall of the fixed portion.

The lower adjustable portion may include a wall portion and a pair of wings disposed on opposite sides of the wall portion. Each of the wings may include a post. The back wall of the dispenser interface includes a post facing the storage. The fixed portion may include a post facing the storage on a wall of the fixed portion that is opposite the back wall of the dispenser interface. The upper adjustable portion may include a plurality of slots. The slots may be configured to respectively receive the posts and allow the posts to move therein, thereby serving to pivot the lower adjustable portion from the position that is parallel to the opposite wall of the fixed portion to the position that is slanted upwardly away from the opposite wall of the fixed portion.

In another general aspect, a refrigerator/freezer ice bucket may include a plurality of walls connected to each other. One or more of the walls may be adjustable. One or more of the walls may be fixed. One of the adjustable walls may be configured to pivot from a position that is parallel to a portion of the fixed walls to a position in which the one pivoting adjustable wall is fixed to be slanted upwardly away from the portion of the fixed walls, thereby expanding a capacity of the plurality of walls to store ice cubes.

One of the fixed walls may include a bottom floor that connects the adjustable walls to the fixed walls. The bottom floor may be perpendicular to the portion of the fixed walls.

Another one of the pivoting adjustable walls may be configured to pivot while remaining parallel with the portion of the fixed walls.

Another one of the pivoting adjustable walls may be configured to pivot while remaining parallel with the portion of the fixed walls and perpendicular to the bottom floor.

The parallel pivoting adjustable walls may include posts configured to fit slots of the slanting pivoting adjustable wall and the fixed walls.

In another general aspect, a refrigerator/freezer ice bucket may include a dispenser interface configured to deliver ice cubes to an ice dispenser upon a request by a user for the ice cubes. The dispenser interface may include a back wall. The ice bucket may further include storage configured to, with the back wall of the dispenser interface, store the ice cubes until the user request. The storage may include a fixed portion and a hinged outer wall. The fixed portion may be configured, with the back wall of the dispenser interface, to control a capacity of the storage to store the ice cubes by allowing the hinged outer wall to pivot.

The fixed portion may be further configured, with the back wall of the dispenser interface, to allow the hinged outer wall to pivot to a position in which one or more portions of the hinged outer wall are slanted upwardly away from the fixed portion to increase the capacity of the storage.

The fixed portion and the back wall of the dispenser interface may include slots through which posts of the hinged outer wall are allowed to move to cause the hinged outer wall to pivot, thereby adjusting the capacity of the storage.

The capacity of the storage may increase as a distance between the fixed portion and the hinged outer wall increases.

Other features and aspects may be apparent from the following detailed description, the drawings, and the claims.

Figure 1A:
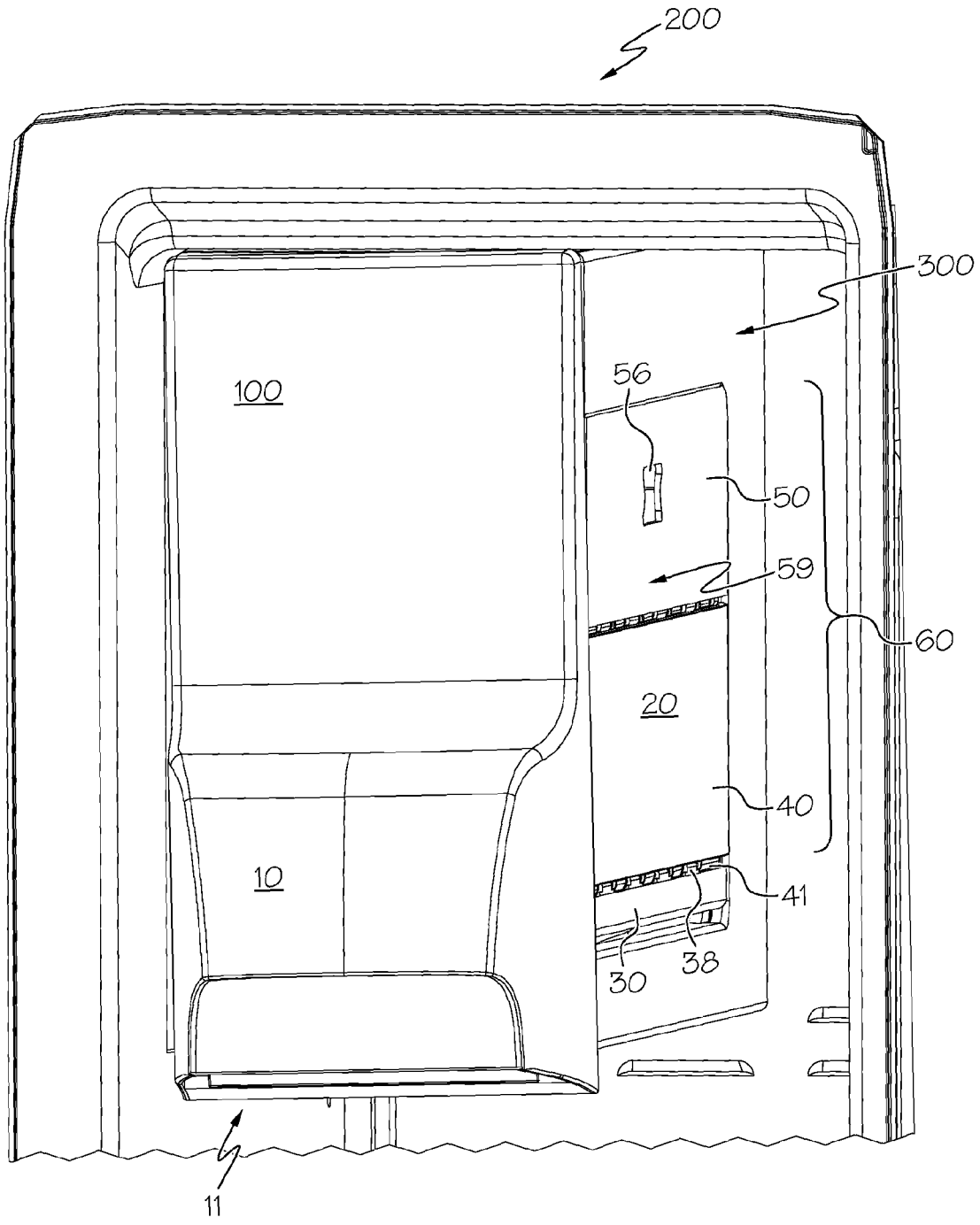
FIG. 1A is a perspective view illustrating an example of a refrigerator/freezer ice bucket installed in a refrigerator/freezer unit.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Examples incorporating one or more aspects of the present invention are described and illustrated in the drawings. These illustrated examples are not intended to be limiting. For example, one or more aspects of the present invention may be utilized in other embodiments and even other types of devices.

Examples of the present invention may be applicable to a variety of buckets, drawers, and/or compartments in which expandable storage may be desired, such as, but not limited to, those storing vegetables, meats, fruits, deli items, or any other buckets, drawers, or compartments known by one having ordinary skill in the art to be applicable.

For purposes of the following descriptions and illustrations, a refrigerator/freezer unit is an electrically cooled compartment or a plurality of electrically cooled compartments combined into a single unit, where one or more of the cooled compartments has the ability to transform water from a liquid state to a solid (frozen) state and maintain the water in the solid (frozen) state by exposing the water to temperatures below a freezing point of water for an indeterminate period of time.

Figure 1B:
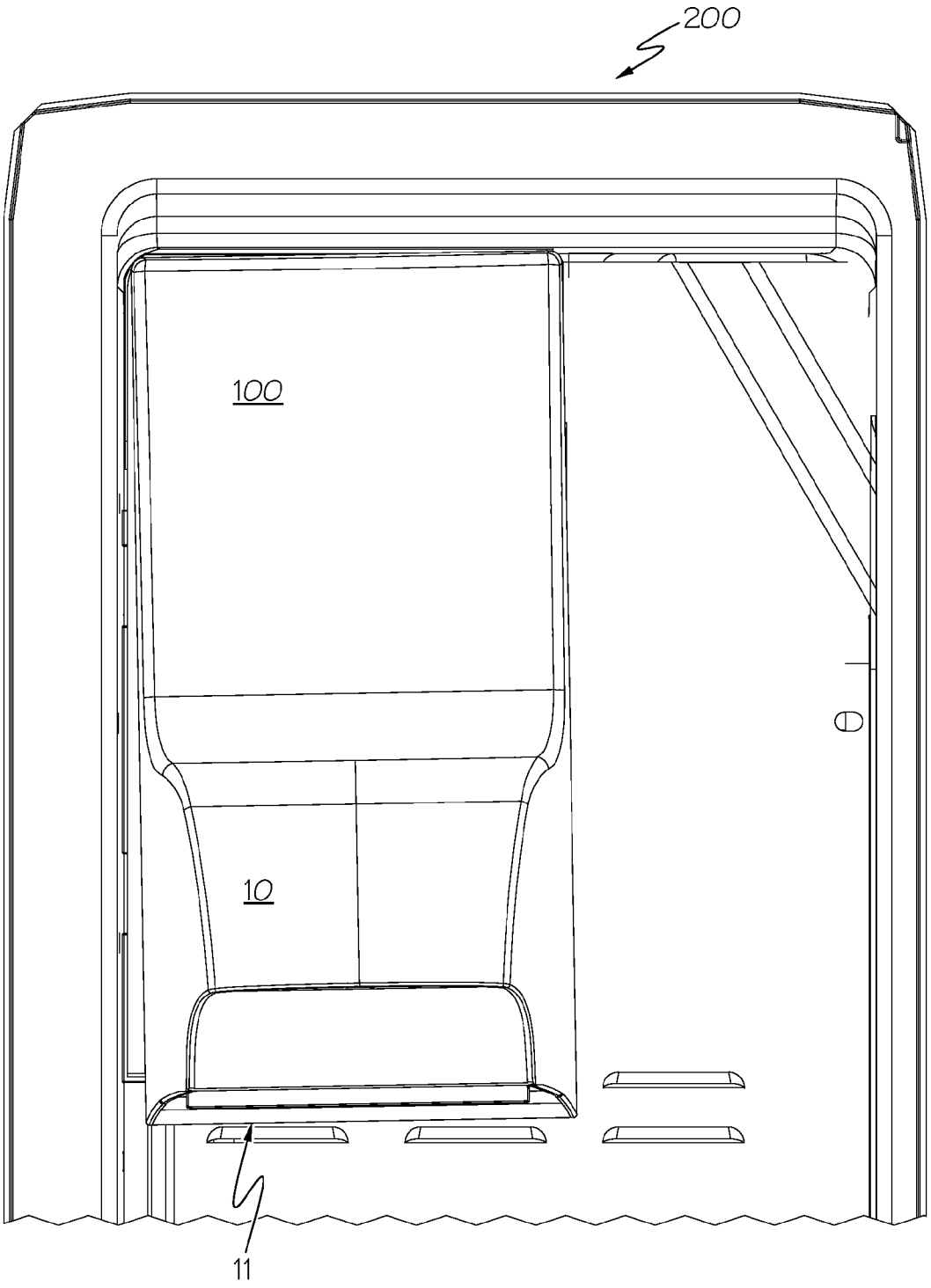
FIG. 1B is a front view illustrating an example of the refrigerator/freezer ice bucket installed in the refrigerator/freezer unit.
Figure 1C:
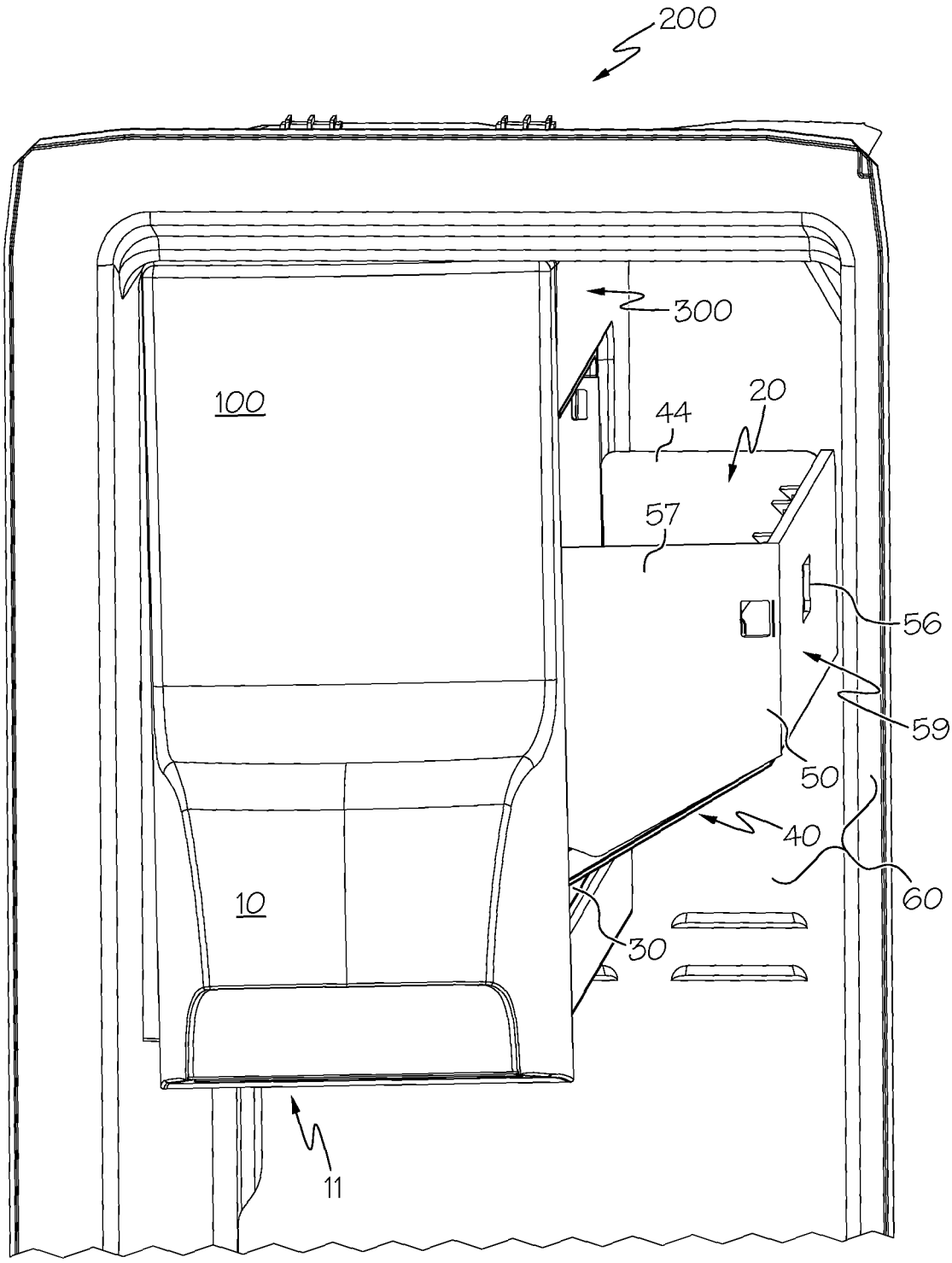
FIG. 1C is a perspective view illustrating an example of a refrigerator/freezer ice bucket installed in a refrigerator/freezer unit in which the storage of the refrigerator/freezer ice bucket has been fully expanded.
Figure 1D:
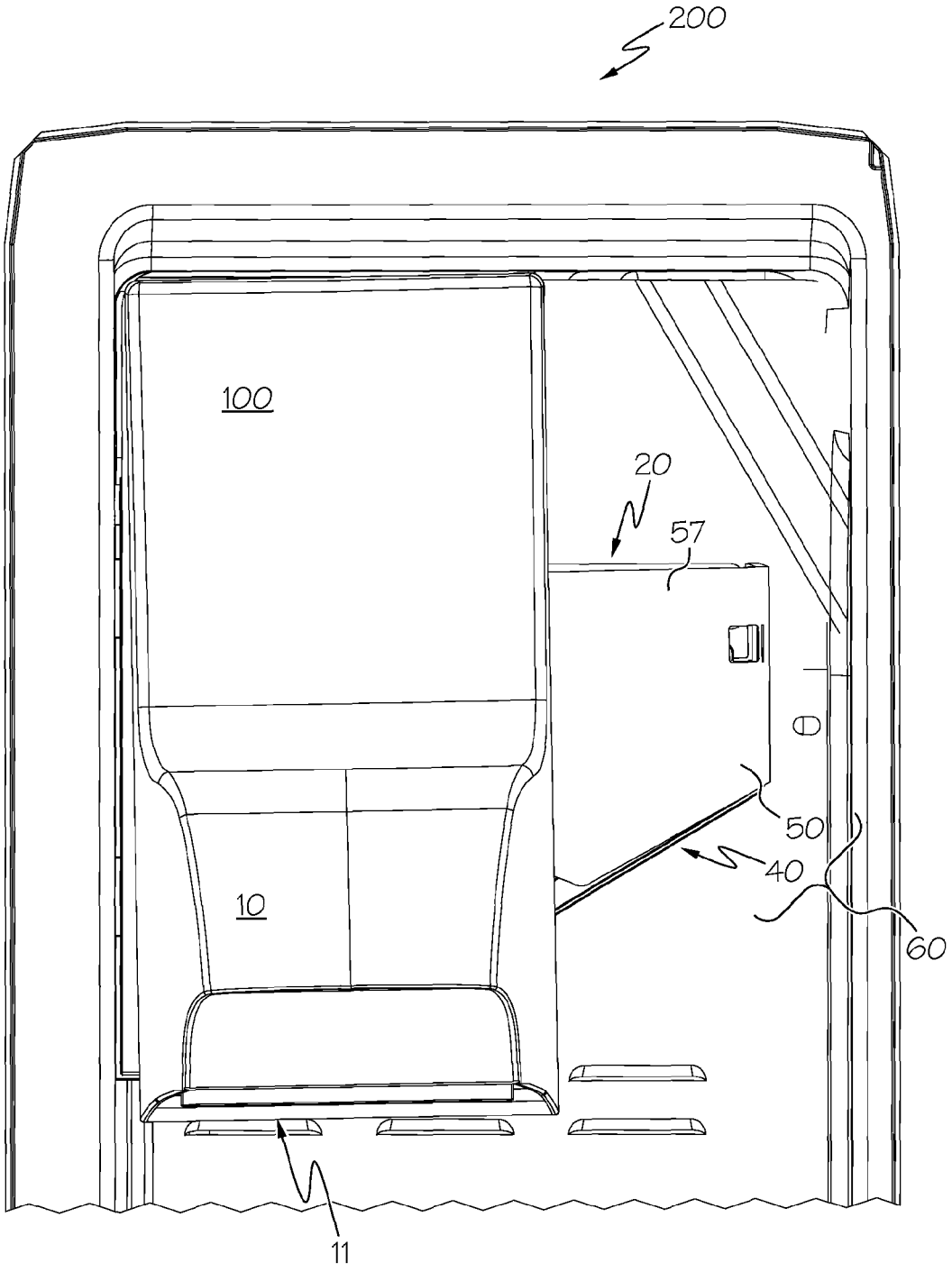
FIG. 1D is a front view illustrating an example of the refrigerator/freezer ice bucket installed in the refrigerator/freezer unit in which the storage of the refrigerator/freezer ice bucket has been fully expanded.
Figure 2:
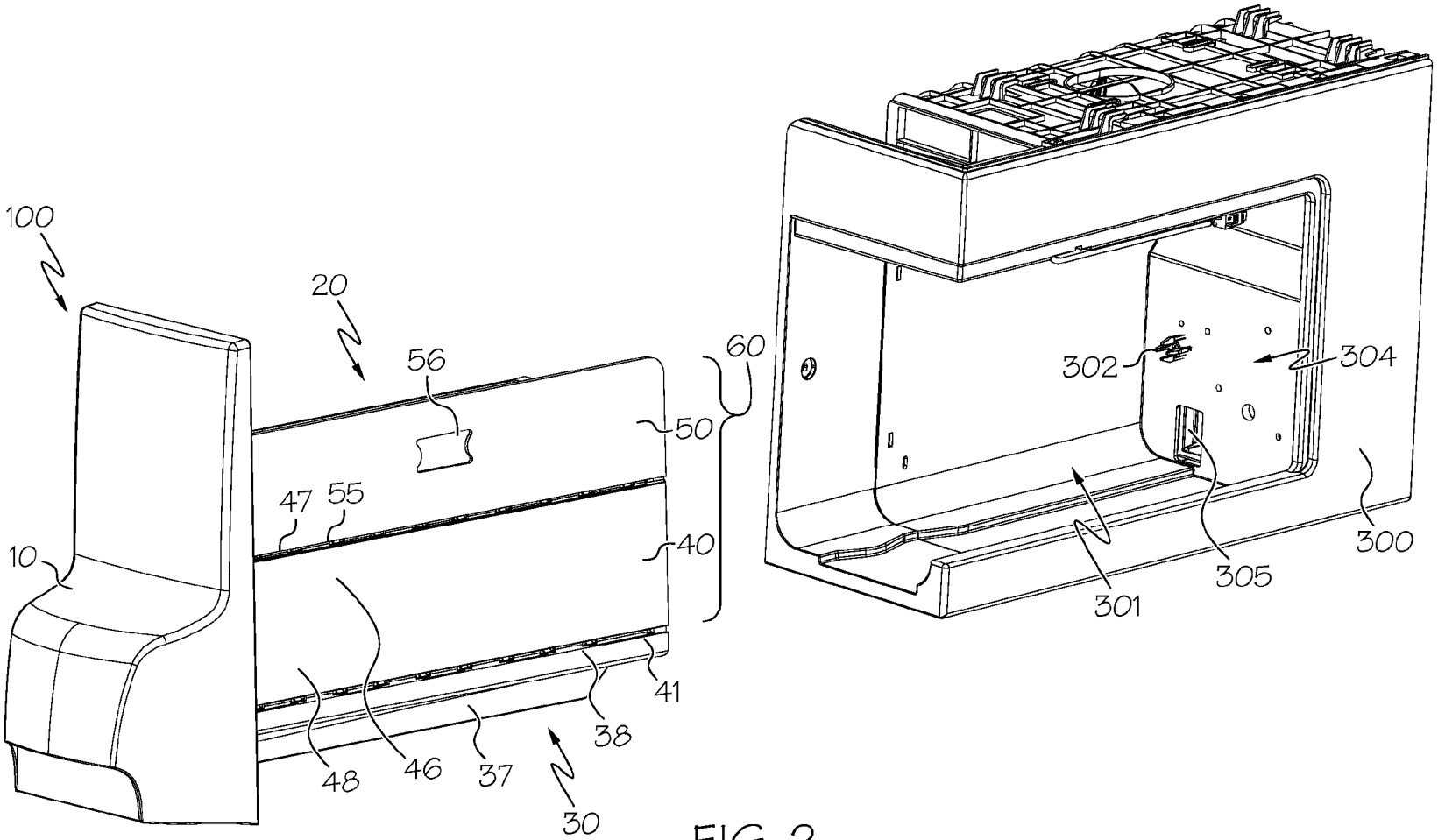
FIG. 2 is a front view illustrating an example of the refrigerator/freezer ice bucket and its correspondence with an icemaker.
Figure 3A:
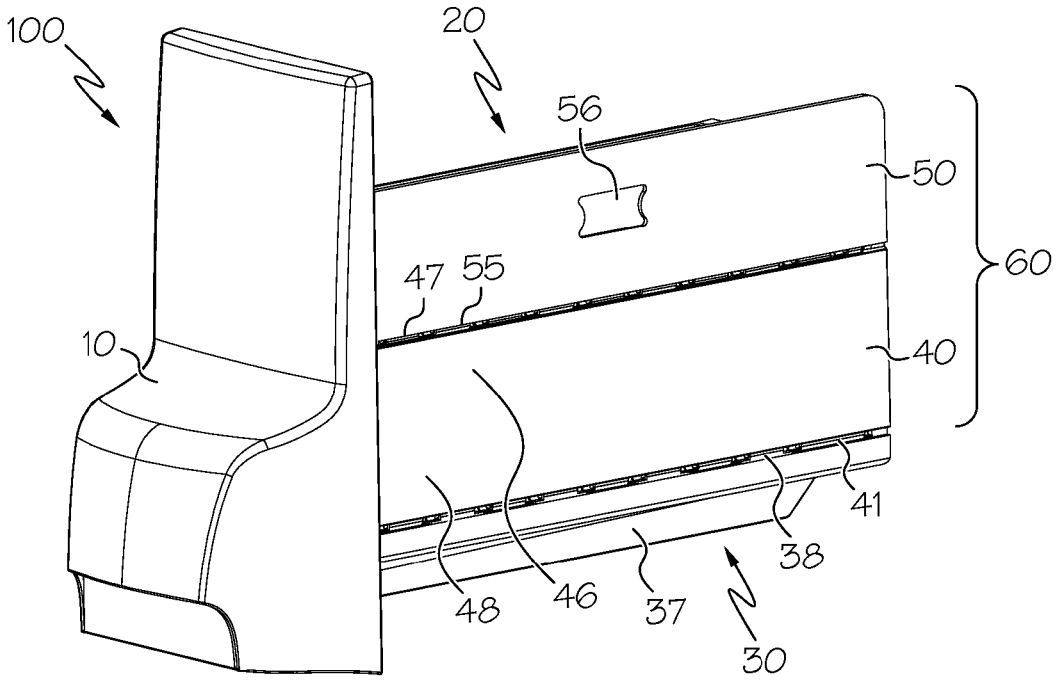
FIG. 3A is a perspective view illustrating an example of the refrigerator/freezer ice bucket.
Figure 3B:
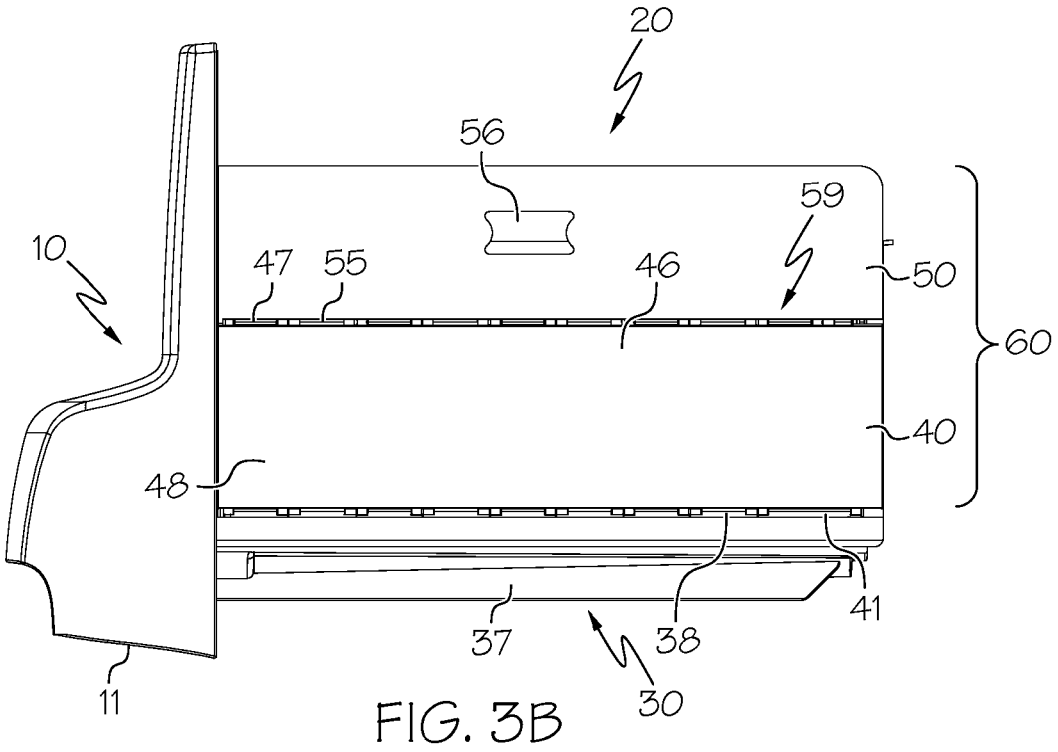
FIG. 3B is a side view illustrating an example of the refrigerator/freezer ice bucket.
Figure 3D:
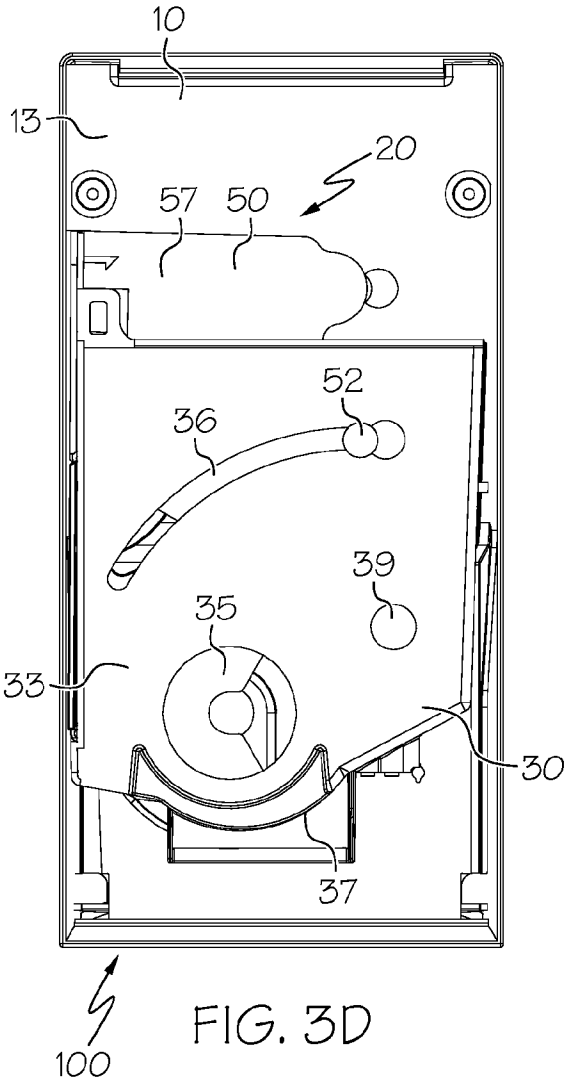
FIG. 3D is a rear view illustrating an example of the refrigerator/freezer ice bucket.
Figure 3C:
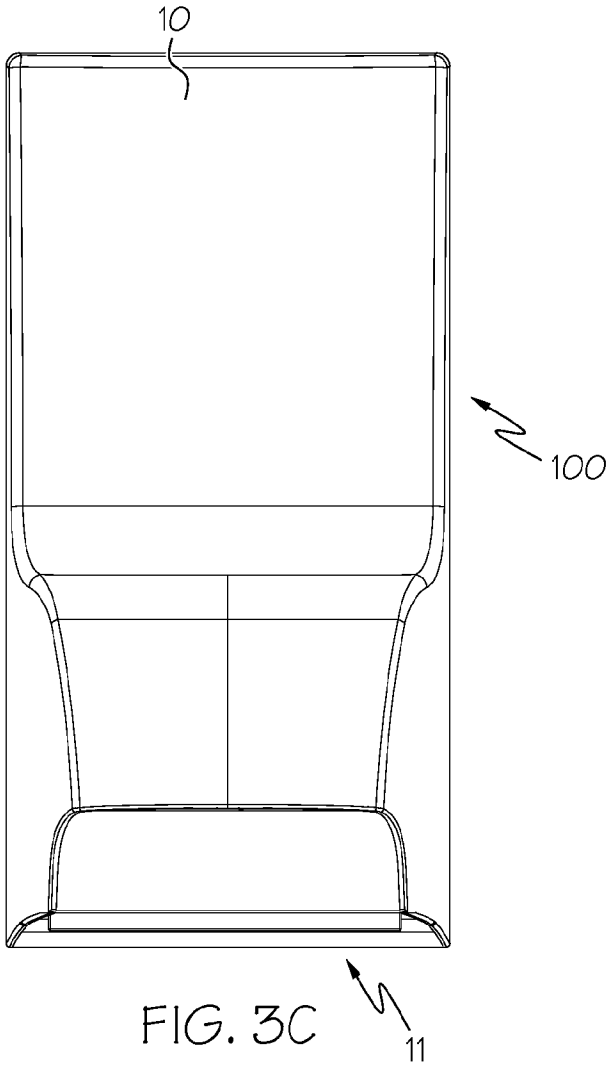
FIG. 3C is a front view illustrating an example of the refrigerator/freezer ice bucket.
Figure 3E:
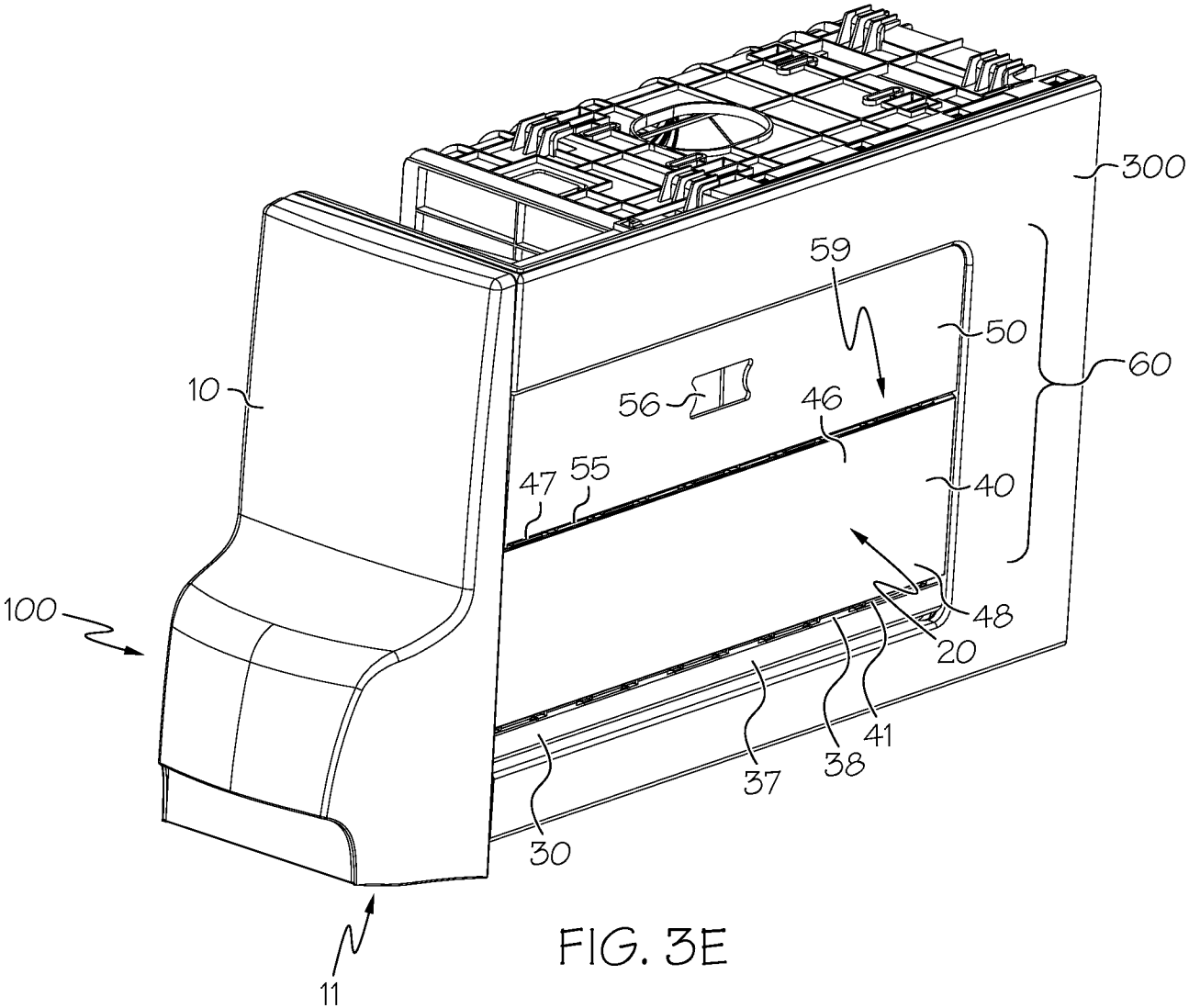
FIG. 3E is a perspective view illustrating an example of the refrigerator/freezer ice bucket installed in the icemaker.
Figure 4A:
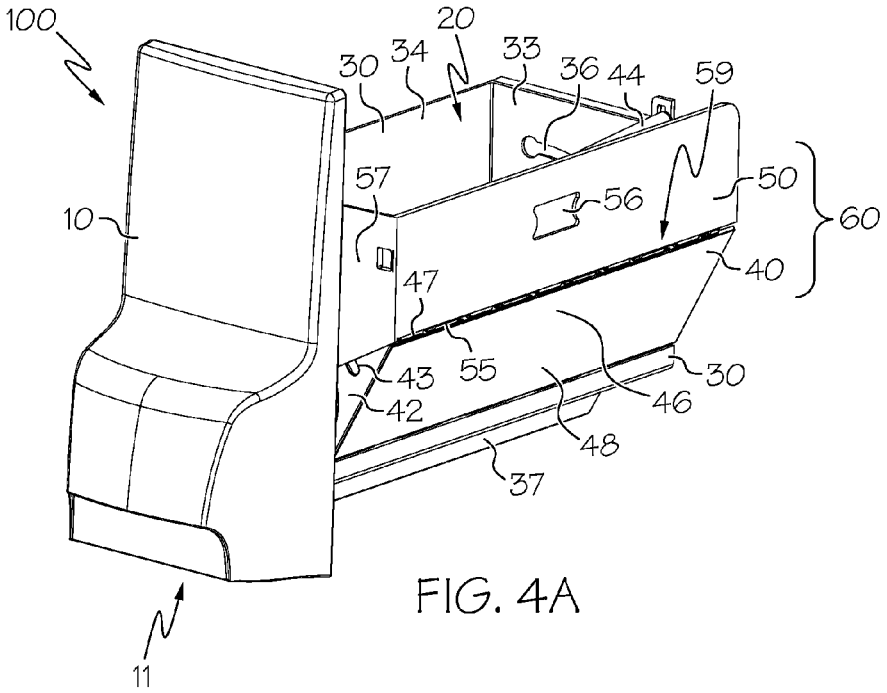
FIG. 4A is a front perspective view illustrating an example of the refrigerator/freezer ice bucket in which the storage of the refrigerator/freezer ice bucket is in the midst of being expanded.
Figure 4B:
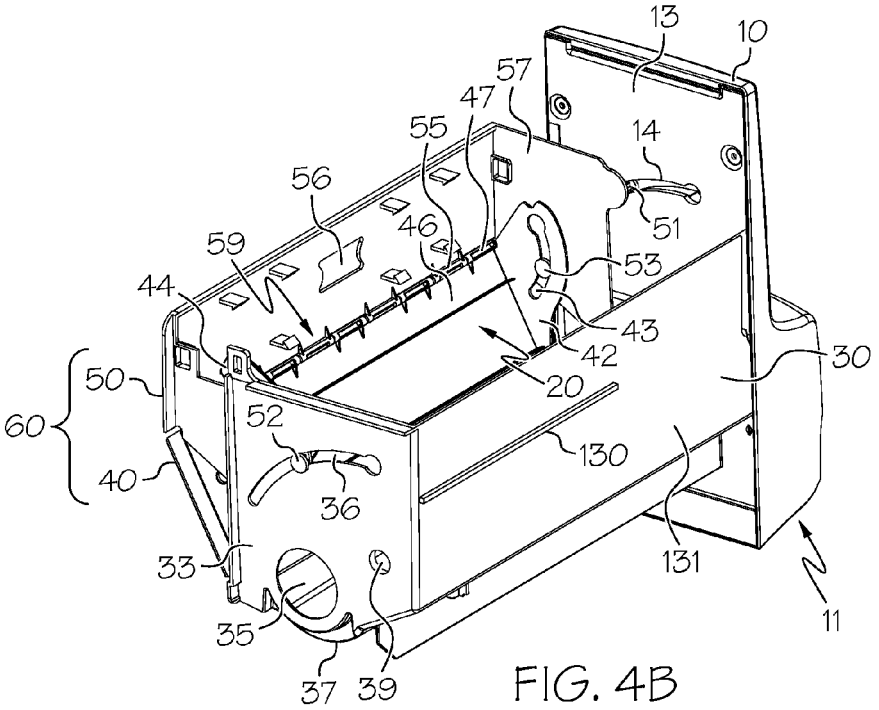
FIG. 4B is a rear perspective view illustrating an example of the refrigerator/freezer ice bucket in which the storage of the refrigerator/freezer ice bucket is in the midst of being expanded.
Figure 4D:
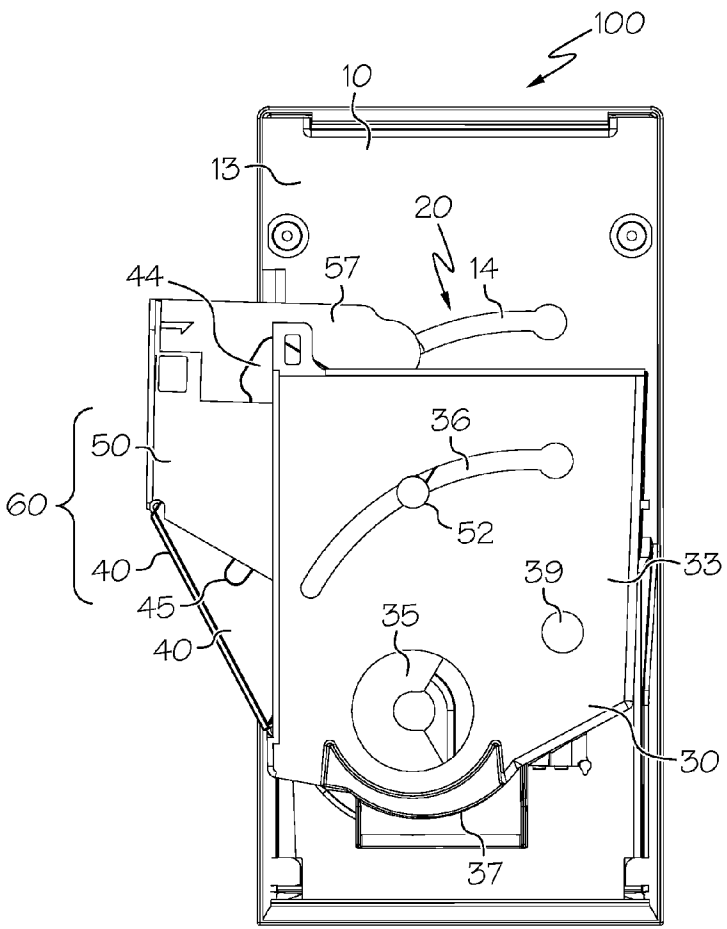
FIG. 4D is a rear view illustrating an example of the refrigerator/freezer ice bucket in which the storage of the refrigerator/freezer ice bucket is in the midst of being expanded.
Figure 4C:
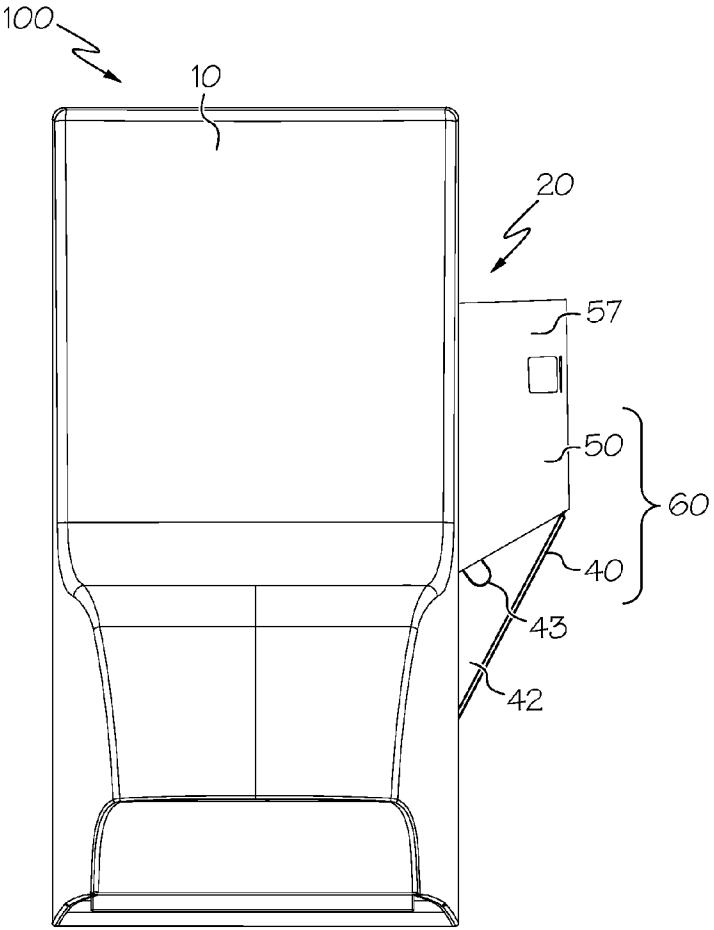
FIG. 4C is a front view illustrating an example of the refrigerator/freezer ice bucket in which the storage of the refrigerator/freezer ice bucket is in the midst of being expanded.
Figure 4E:
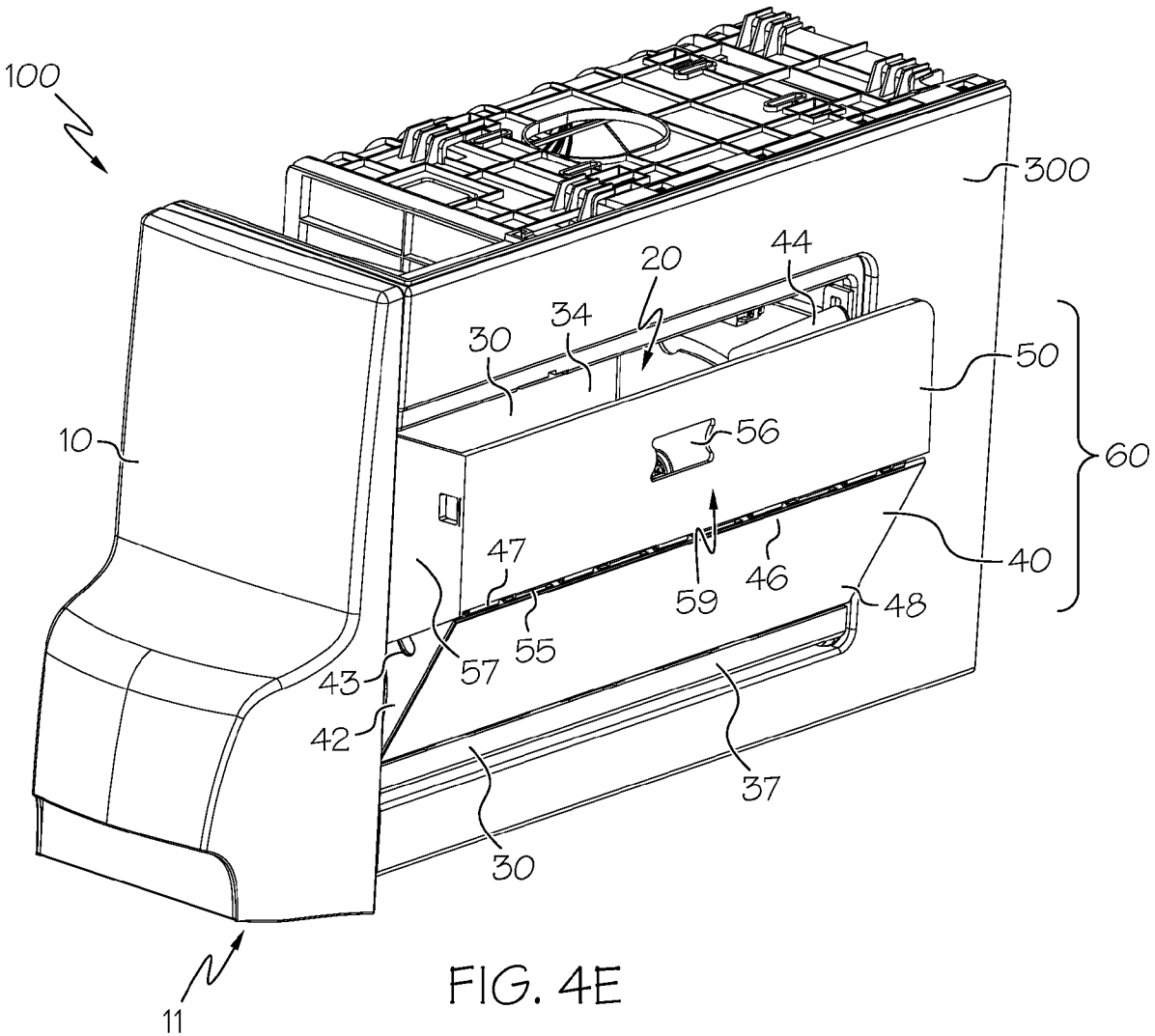
FIG. 4E is a perspective view illustrating an example of the refrigerator/freezer ice bucket installed in the icemaker in which the storage of the refrigerator/freezer ice bucket is in the midst of being expanded.
Figure 5A:
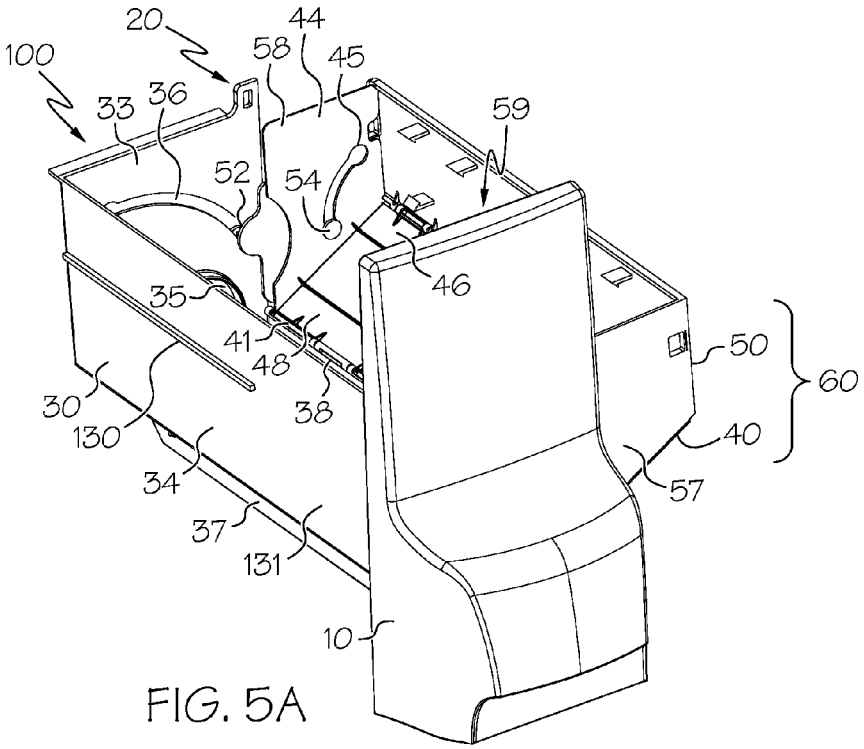
FIG. 5A is a front perspective view illustrating an example of the refrigerator/freezer ice bucket in which the storage of the refrigerator/freezer ice bucket has been fully expanded.
Figure 5B:
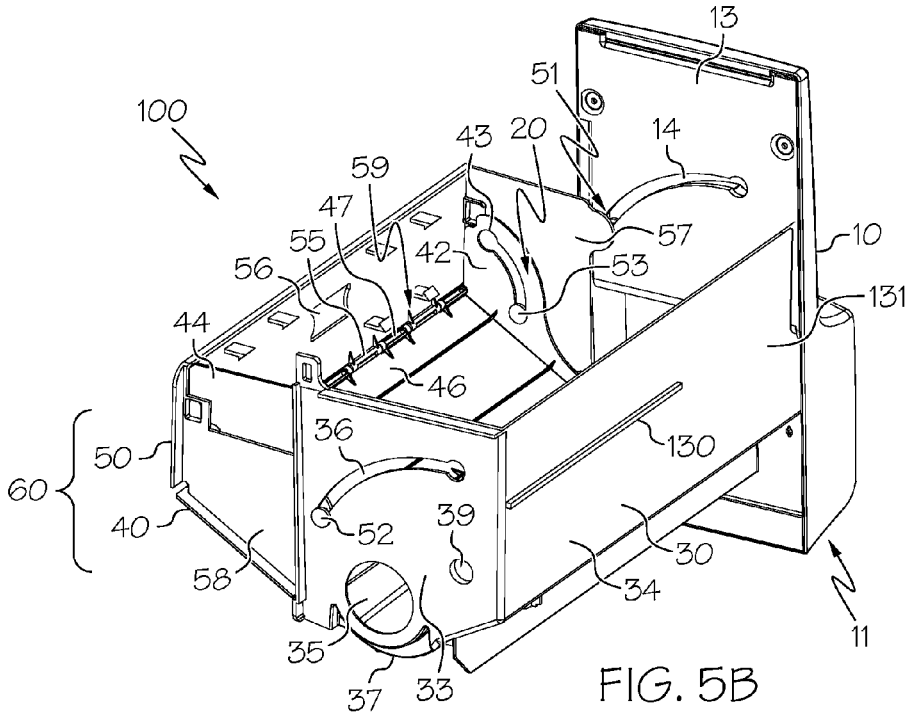
FIG. 5B is a rear perspective view illustrating an example of the refrigerator/freezer ice bucket in which the storage of the refrigerator/freezer ice bucket has been fully expanded.
Figure 5D:
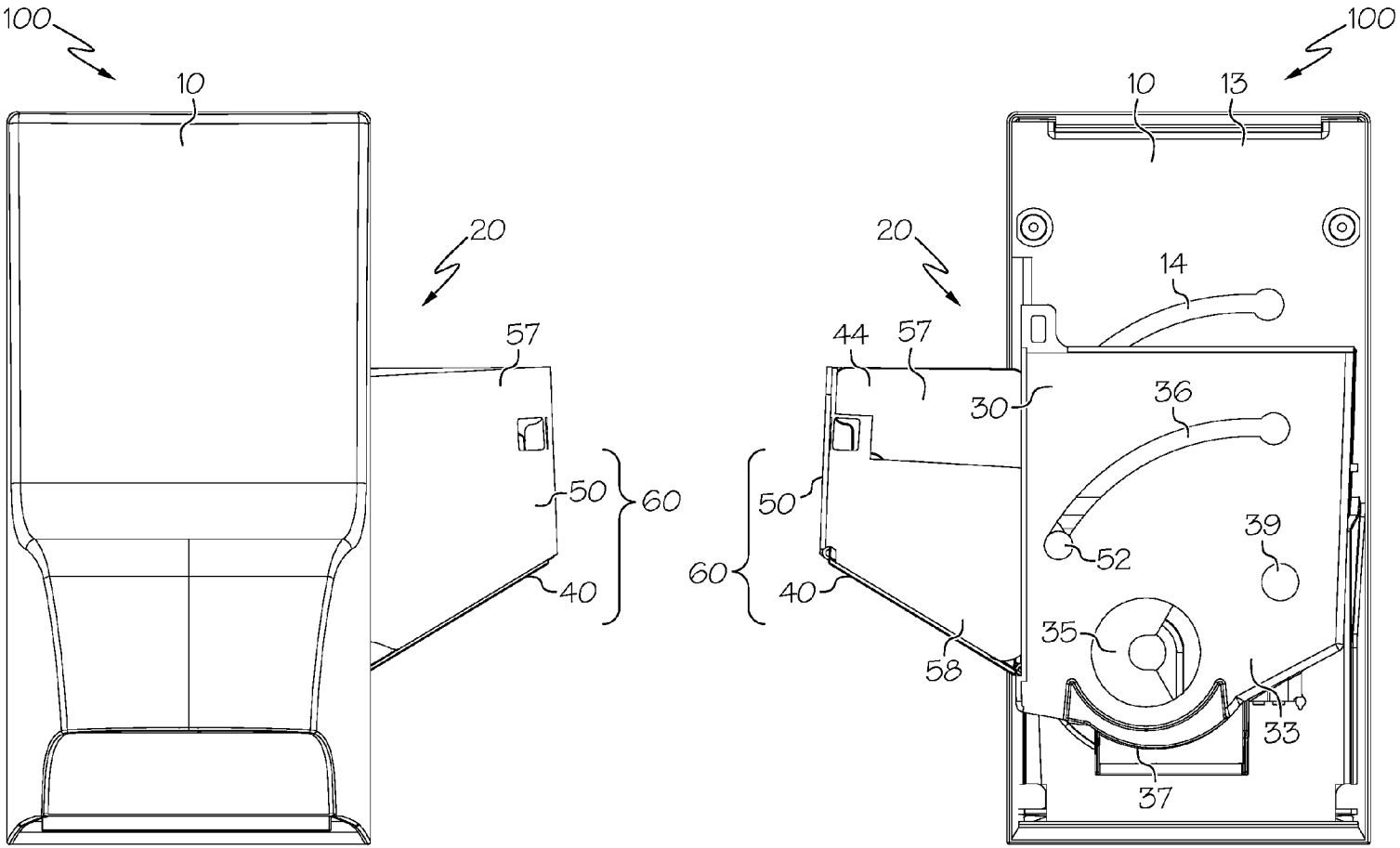
FIG. 5D is a rear view illustrating an example of the refrigerator/freezer ice bucket in which the storage of the refrigerator/freezer ice bucket has been fully expanded.
Figure 5C:
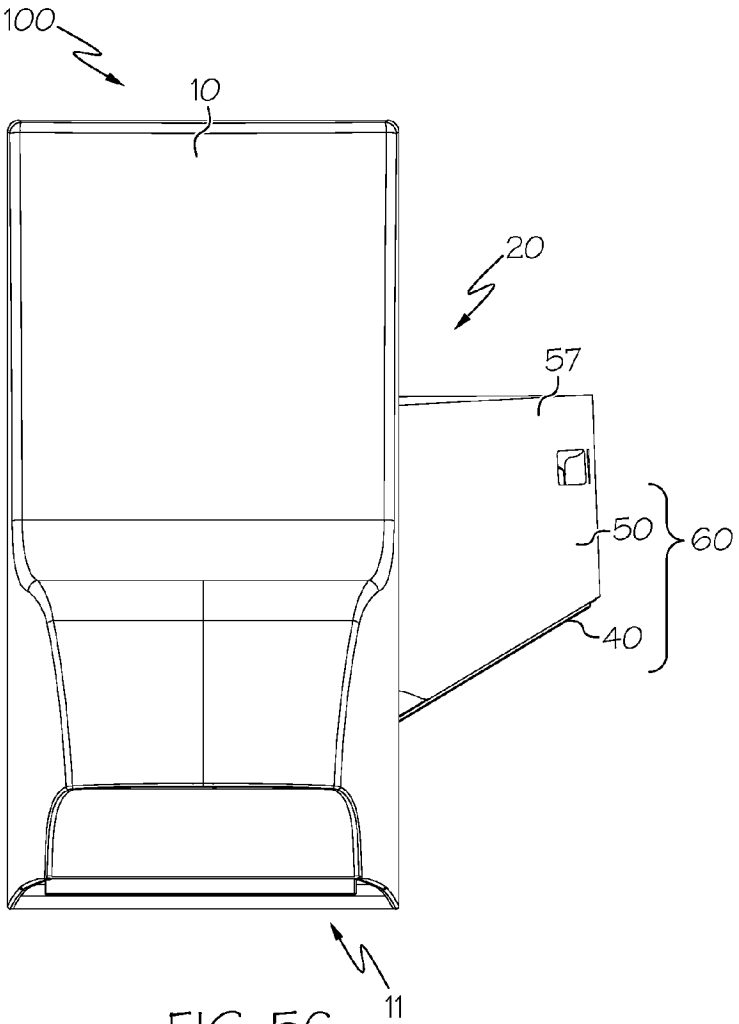
FIG. 5C is a front view illustrating an example of the refrigerator/freezer ice bucket in which the storage of the refrigerator/freezer ice bucket has been fully expanded.
Figure 5E:
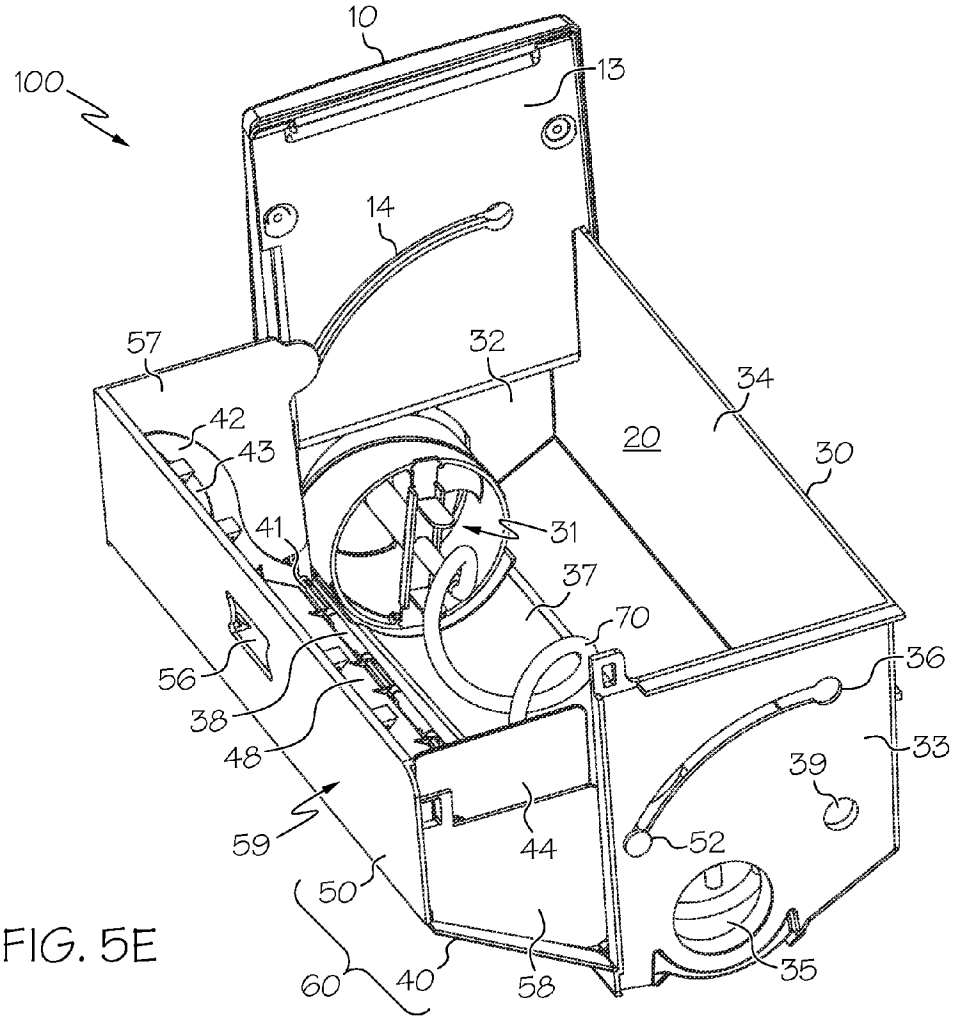
FIG. 5E is a rear elevated view illustrating an example of the refrigerator/freezer ice bucket in which the storage of the refrigerator/freezer ice bucket has been fully expanded.

FIGS. 1A-1D are views illustrating an example of an ice bucket 100 in varied states of expansion installed in refrigerator/freezer unit 200. FIGS. 1A and 1B illustrate the ice bucket 100 in a normal state. FIGS. 1C and 1D illustrated the ice bucket 100 fully expanded. FIG. 2 is a front view illustrating an example of the refrigerator/freezer ice bucket 100 and its correspondence with an icemaker 300. FIGS. 3A-5E are views illustrating various examples of the refrigerator/freezer ice bucket 100. FIGS. 3A-3E illustrate examples in which the storage in the ice bucket 100 has not been expanded. FIGS. 4A-4E illustrate examples in which the storage in the ice bucket 100 is in the midst of being expanded. FIGS. 5A-5E illustrate examples in which the storage in the ice bucket 100 has been fully expanded.

Referring to the examples illustrated in FIGS. 1A-5E, the ice bucket 100 is installed in the icemaker 300 of the refrigerator/freezer unit 200 and may include a dispenser interface 10 and storage 20. The storage 20 may include a fixed portion 30 and an outer wall 60. The outer wall 60 may include a lower adjustable portion 40 and an upper adjustable portion 50.

The icemaker 300 may be mounted in the refrigerator/freezer unit 200 in a location that can accommodate an expansion of the outer wall 60 of the ice bucket 100. The icemaker 300 may include a cavity 301 formed to slidably accept and hold the ice bucket 100 therein so that ice cubes made by the icemaker 300 can be delivered to the storage 20 of the ice bucket 100. The outer wall 60 and a small area of the fixed portion 30 of the ice bucket 100 is substantially planar with a side of the icemaker 300 when the storage 20 is in a position of non A bottom portion 11 of the dispenser interface 10 can mate with an upper portion of an ice dispenser (not shown) located on a door (not shown) of the refrigerator/freezer unit 200 such that, when ice cubes are requested by a user, ice cubes can be pulled from the storage 20 of the ice bucket 100 by an auger 70. The auger 70 can pull the ice cubes through a front hole 31 in a front wall 32 of the fixed portion 30. The ice cubes that are pulled through the front hole 31 in the front wall 32 of the fixed portion enter a cavity (not shown) in the dispenser interface 10. The cavity of the dispenser interface 10 connects with the bottom portion 11 of the dispenser interface 10, through which ice cubes are provided to the ice dispenser for delivery to the user.

The back wall 13 of the dispenser interface 10 may partially define a boundary of the storage 20. The back wall 13 of the dispenser interface 10 may also include a curved slot 14. The curved slot 14 may accept a front upper post 51 on a front winged part 57 of the upper adjustable portion 50 of the outer wall 60 and define a path in which the front upper post 51 can be moved.

The fixed portion 30 of the storage 20 may be defined by two parallel opposing walls disposed at a front 32 and a back 33 of the ice bucket 100, a long wall 34 disposed perpendicularly to the front wall 32 and the back wall 33, and a bottom floor 37 connecting the front wall 32, the back wall 33, and the long wall 34. The bottom floor 37 may include one or more portions that are perpendicular to the front wall 32, the back wall 33, the long wall 34, and one or more portions of the outer wall 60 including the upper adjustable portion 50.

The long wall 34 may connect the front wall 32 and the back wall 33 at perpendicular angles. The front wall 32 may have an elevation that is less than an elevation of the back wall 33. The front wall 32 may be disposed underneath and forward of the black wall 13 of the dispenser interface 10. The fixed portion 30 may not have a wall that is disposed opposite the long wall 34 at an opposite side of the bottom floor 37 from the long wall 34. As such, the outer wall 60 may be disposed opposite the long wall 34 at the opposite side of the bottom floor 37 from the long wall 34. The front wall 32 of the fixed portion 30 may include the front hole 31 through which the auger 70 pulls ice cubes.

On an outer portion 131 of the long wall 34, the bucket 100 may include a guide 130. The guide 130 may be implemented as a ridge or a hook that extends horizontally along a substantially central portion of the outer portion 131 of the long wall 34. The guide 130 can mate with a corresponding surface of the icemaker 300 to enable proper securing of the bucket 100 to the icemaker 300. The guide 130 may also provide rigidity to the long wall 34 to enable the bucket 100 to withstand torque inflicted on the bucket 100 by operation of the auger 70. As a result, the bucket 100 may be inhibited from warping of the bucket 100 that can be caused by repeated operation of the auger 70.

A lower portion of the back wall 33 of the fixed portion 30 may include a back hole 35 through which an end of the auger 70 protrudes to be engaged with a shaft 305 of an auger motor (not shown) of the icemaker 300. The shaft 305 operates the movement of the auger 70 to enable ice cubes to be pulled through the front hole 31 and delivered from the dispenser interface 10 to the ice dispenser (not shown).

A portion of the back wall 33 of the fixed portion 30 may include a small hole 39. This small hole 39 may accept protrusions 303 on a back wall 304 of the icemaker 300. The small hole 39 is configured to secure the bucket 100 to the icemaker 300 via the protrusions 303. As a result, the bucket 100 may be inhibited from moving forward during operation of the auger 70 and warping that can be caused by torque being repeatedly applied to the bucket 100 because of operation of the auger 70.

An upper portion of the back wall 33 of the fixed portion 30 may include a curved slot 36 formed opposite the curved slot 14 of the back wall 13 of the dispenser interface 10. The curved slot 36 may have an elevation on the back wall 33 of the fixed portion 30 that is less than an elevation of the curved slot 14 on the back wall 13 of the dispenser interface 10. The curved slot 36 may have a shape that corresponds with a shape of the curved slot 14.

The curved slot 36 can accept a rear upper post 52 of a rear winged part 58 of the upper adjustable portion 50 and define a path in which the rear upper post 52 can be moved. The rear upper post 52 may have an elevation on the upper adjustable portion 50 that is less than an elevation of the front upper post 51 on the upper adjustable portion 50. The elevations of the rear upper post 52 and the front upper post 51 may respectively correspond with the elevations of the curved slot 36 on the back wall 13 of the fixed portion and the curved slot 14 on the back wall 13 of the dispenser interface 10. The movement of the rear upper post 52 in the curved slot 36 may mirror the movement of the front upper post 31 in the curved slot 14. The rear upper post 52 may face in a direction that is opposite a direction that the front upper post faces. The front upper post 51 and the rear upper post 52 may both face away from a center of the ice bucket 100.

The bottom floor 37 of the fixed portion 30 may have a plurality of hinge post acceptors 38 disposed at the opposite side of the bottom floor 37 from the long wall 34. The lower adjustable portion 40 of the outer wall 60 can connect to the fixed portion 30 by way of a plurality of hinge posts 41 disposed on a lower edge 48 of the lower adjustable portion 40. The hinge posts 41 may correspondingly mate with the hinge post acceptors 38 of the bottom floor 37 to allow the lower adjustable portion 40 to move while being connected to the bottom floor 37.

The orientation of the hinge between the fixed portion 30 and the lower adjustable portion 40 is not limited to the example above. For example, the bottom portion 37 of the fixed portion 30 can have a plurality of hinge posts disposed at the opposite side of the bottom floor 37 from the long wall 34. Further, the lower adjustable portion 40 of the outer wall 60 can connect to the fixed portion 30 by way of a plurality of hinge post acceptors disposed on the lower edge 48 of the lower adjustable portion 40. The hinge post acceptors can correspondingly mate with the hinge posts of the bottom floor 37 to allow the lower adjustable portion 40 to move while being connected to the bottom floor 37.

A front winged part 42 of the lower adjustable portion 40 may have a front curved slot 43. An upper rear winged part 44 of the lower adjustable portion 40 may have a rear curved slot 45. The front curved slot 43 on the front winged part 42 may be disposed opposite the rear curved slot 45 on the upper rear winged part 44. The front curved slot 43 may have an elevation that is the same as an elevation of the rear curved slot 45. The front curved slot 43 may have a shape that corresponds with a shape of the rear curved slot 45.

The upper adjustable portion 50 may include a front lower post 53 and a rear lower post 54 respectively disposed on the front winged part 57 and the rear winged part 58. The front curved slot 43 and the rear curved slot 45 can respectively accept the front lower post 53 and the rear lower post 54 of the upper adjustable portion 50 and define paths in which the front lower post 53 and the rear lower post 54 can be moved. The front lower post 53 may have an elevation on the upper adjustable portion 50 that is the same as an elevation of the rear lower post 54 on the upper adjustable portion 50. The movement of the front lower post 53 in the front curved slot 43 may mirror the movement of the rear lower post 54 in the rear curved slot 45. The front lower post 53 may face in a direction that is opposite a direction that the rear lower post 54 faces. The front lower post 53 and the rear lower post 54 may both face toward a center of the ice bucket 100.

An upper edge 46 of the lower adjustable portion 40 may have a plurality of hinge post acceptors 47. The hinge post acceptors 47 of the upper edge 46 may be disposed at an opposite side of the lower adjustable portion 40 from the hinge posts 41 disposed on the lower edge 48 of the lower adjustable portion 40. The upper adjustable portion 50 may connect to the lower adjustable portion by way of a plurality of hinge posts 55 disposed on a lower edge 59 of the upper adjustable portion 50. The hinge posts 55 correspondingly mate with the hinge post acceptors 47 to allow the lower adjustable portion 40 to move while being connected to the upper adjustable portion 50.

The orientation of the hinge between the lower adjustable portion 40 and the upper adjustable portion 50 is not limited to the example above. For example, an upper edge 46 of the lower adjustable portion 40 can have a plurality of hinge posts. The hinge posts of the upper edge 46 can be disposed at an opposite side of the lower adjustable portion 40 from the hinge posts 41 disposed on the lower edge 48 of the lower adjustable portion 40. The upper adjustable portion 50 can connect to the lower adjustable portion by way of a plurality of hinge post acceptors disposed on a lower edge 59 of the upper adjustable portion 50. The hinge post acceptors can correspondingly mate with the hinge posts to allow the lower adjustable portion 40 to move while being connected to the upper adjustable portion 50.

The slots 14, 36, 43 45 respectively serve to guide the posts 51, 52, 53, 54 of the upper adjustable portion 50 along a specific course. The slots 14, 36, 43, 45 may be oriented to provide the posts 51, 52, 53, 54 with room to move along the specific course. In addition, the slots 13, 36, 43, 45 may be oriented to inhibit any movement by the posts 51, 52, 53, 54 that would serve to adjust a parallel relationship between the upper adjustable portion 50 and the long wall 34 of the fixed portion 30. In other words, while the upper adjustable portion 50 may be pivoted through interaction with the slots 13, 36, 43, 45 and the posts 51, 52, 53, 54 to allow an angular relationship with the lower adjustable portion 40 to change, the slots 13, 36, 43, 45 and the posts 51, 52, 53, 54 may be oriented such that a parallel relationship between the upper adjustable portion 50 and the long wall 34 of the fixed portion 30 never changes. Further, a plane in which the upper adjustable portion 50 resides may remain parallel to a plane in which the long wall 34 resides during any movement of the upper adjustable portion 50 and the lower adjustable portion. Moreover, any movement of the upper adjustable portion 50 and the lower adjustable portion 40 may alter angles between the lower adjustable portion 40 and both the upper adjustable portion 50 and the bottom floor 37.

The upper adjustable portion 50 may have a notch 56 that enables a user of the refrigerator/freezer unit 200 to expand the ice bucket 100 by grabbing the upper adjustable portion 50 around the notch 56 and subsequently pulling the upper adjustable portion 50 via the notch 56 in a direction away from the long wall 34. When the ice bucket 100 is in a state of non-expansion and a user wishes to move the ice bucket to a state of full expansion, the user may pull the grabbed upper adjustable portion 50 in the direction away from the long wall 34. This pulling may serve to initiate movement of each of the posts 51, 52, 53, 54 with respect to each of the slots 14, 36, 43, 45 until the posts 51, 52, 53, 54 are at a respective position in the slots 14, 36, 43, 45 that is at an opposite end of slots 14, 36, 43, 45 from which the posts 51, 52, 53, 54 began movement. In other words, the user's initiation of movement of the posts 51, 52, 53, 54 with respect to each of the slots 14, 36, 43, 45 by pulling may bring the ice bucket 100 to a state of full expansion from the state of non-expansion.

When a user wishes to move the ice bucket 100 from the state of full expansion back to the state of non-expansion, a used can grab the upper adjustable portion 50 around the notch 56 and subsequently push the upper adjustable portion 50 in a direction toward the long wall 34. This pushing may serve to initiate movement of each of the posts 51, 52, 53, 54 with respect to each of the slots 14, 36, 43, 45 until the posts 51, 52, 53, 54 are at a respective position in the slots 14, 36, 43, 45 that is at an opposite of the slots 14, 36, 43, 45 from which the posts 51, 52, 53, 54 began movement. In other words, the user's initiation of movement of the posts 51, 52, 53, 54 with respect to each of the slots 14, 36, 43, 45 by pushing may bring the ice bucket 100 from the state of full expansion to the state of non-expansion.

It should be noted that, when ice buckets are actively being stored by an ice bucket 100 in the state of full expansion, depending on a volume and weight of ice cubes being stored in the ice bucket 100, the user may be inhibited from pushing the ice bucket 100 to the state of non-expansion. A volume and weight of ice cubes in the ice bucket 100 at a time in which the ice bucket 100 is in a state of non-expansion may serve to facilitate the expansion of the ice bucket 100 when the notch 56 is used to pull the upper adjustable portion 50 in the direction away from the long wall 34.

When the ice bucket 100 is in the state of non-expansion, the lower adjustable portion 40 may be at its highest elevation. When the ice bucket 100 is in the state of full expansion, the lower adjustable portion 40 may be at its lowest elevation.

When the ice bucket 100 is in the state of non-expansion, a plane in which the lower adjustable portion 40 resides may be parallel to the plane in which the long wall 34 resides. When the ice bucket 100 is in the state of full expansion, a plane in which the lower adjustable portion 40 resides may not be parallel to the plane in which the long wall 34 resides.

When the ice bucket 100 is in the state of non-expansion, the posts 51, 52, 53, 54 may be at their highest elevation. When the ice bucket 100 is in the state of full expansion, the posts 51, 52, 53, 54 may be at their lowest elevation.

When the ice bucket 100 is in the state of non-expansion, the front upper post 51 and the rear upper post 52 may be at their closest to the long wall 34, and the front lower post 53 and the rear lower post 54 may be at their farthest from the long wall 34. When the ice bucket 100 is in the state of full expansion, the front upper post 51 and the rear upper post 52 may be at their farthest from the long wall 34, and the front lower post 53 and rear lower post 54 may be at their closest to the long wall 34.

The orientation of the slots and posts of the ice bucket 100 is not limited to the examples described above. For example, the posts 51, 52, 53, 54 of the upper adjustable portion 50 can be replaced with slots depending on an expanded size of the front winged part 57 and the rear winged part 58. Correspondingly, slots 13, 36, 43, and 45 can be replaced with posts that can be received by the slots provided in the expanded front winged part 57 and the expanded rear winged part 58.

In addition, various prongs, posts, clips, receptacles, and similar mechanisms known to one having ordinary skill in the art may be implemented on the lower adjustable portion 40 and/or the upper adjustable portion 50 so that the ice bucket 100 may be placed in a state of partial expansion. Moreover, various prongs, posts, clips, receptacles, and similar mechanisms known to one having ordinary skill in the art may be implemented on the lower adjustable portion 40 and/or the upper adjustable portion 50 so that the ice bucket 100 may be locked in the state of non-expansion, the state of partial expansion, or the state of full expansion.

A number of examples have been described above. Nevertheless, it will be understood that various modifications may be made. For example, suitable results may be achieved if the described elements are combined in a different manner and/or replaced or supplemented by other elements or their equivalents. Accordingly, other implementations are within the scope of the following claims.

What is claimed is:

1. A refrigerator/freezer ice bucket, comprising:

a dispenser interface configured to deliver ice cubes to an ice dispenser upon a request by a user for the ice cubes, the dispenser interface comprising a back wall; and storage configured to, with the back wall of the dispenser interface, store the ice cubes until the user request, the storage comprising a fixed portion and a hinged outer wall, the hinged outer wall being configured to pivot from a position that is parallel to an opposite wall of the fixed portion to a position in which one or more portions of the hinged outer wall are fixed to be slanted upwardly away from the opposite wall of the fixed portion, thereby expanding a capacity of the storage.

2. The refrigerator/freezer ice bucket of claim 1, wherein the hinged outer wall comprises a lower adjustable portion hinged to the fixed portion and an upper adjustable portion hinged to the lower adjustable portion.

3. The refrigerator/freezer ice bucket of claim 2, wherein the lower adjustable portion is configured to pivot from a position that is parallel to the opposite wall of the fixed portion to a position that is slanted upwardly away from the opposite wall of the fixed portion.

4. The refrigerator/freezer ice bucket of claim 2, wherein the upper adjustable portion is configured to remain in a position that is parallel to the opposite wall of the fixed portion during a pivoting of the lower adjustable portion.

5. The refrigerator/freezer ice bucket of claim 3, wherein the upper adjustable portion is configured to remain in a position that is parallel to the opposite wall of the fixed portion during the pivoting of the lower adjustable portion.

6. The refrigerator/freezer ice bucket of claim 1, wherein the fixed portion comprises a bottom floor disposed adjacent to the opposite wall of the fixed portion, one or more portions of the bottom floor being perpendicular to the opposite wall of the fixed portion, and wherein the portions of the hinged outer wall configured to slant upwardly away from the opposite wall of the fixed portion comprise a lower adjustable portion hinged to the bottom floor of the fixed portion, the bottom floor being disposed between the lower adjustable portion and the opposite wall of the fixed portion.

7. The refrigerator/freezer ice bucket of claim 6, wherein the hinged outer wall further comprises an upper adjustable portion hinged to the lower adjustable portion, the upper adjustable portion being parallel to the opposite wall of the fixed portion and perpendicular to the portions of the bottom floor that are perpendicular to the opposite wall of the fixed portion.

8. The refrigerator/freezer ice bucket of claim 6, wherein the lower adjustable portion is configured to pivot from a position that is parallel to the opposite wall of the fixed portion and perpendicular to the portions of the bottom floor that are perpendicular to the opposite wall of the fixed portion to a position that is slanted upwardly away from the opposite wall of the fixed portion and the portions of the bottom floor that are perpendicular to the opposite wall of the fixed portion.

9. The refrigerator/freezer ice bucket of claim 8, wherein the hinged outer wall further comprises an upper adjustable portion hinged to the lower adjustable portion, the upper adjustable portion being parallel to the opposite wall of the fixed portion and perpendicular to the portions of the bottom floor that are perpendicular to the opposite wall of the fixed portion, the upper adjustable portion being configured to remain parallel to the opposite wall of the fixed portion and perpendicular to the portions of the bottom floor that are perpendicular to the opposite wall of the fixed portion during the pivoting of the lower adjustable portion and a corresponding pivoting of the upper adjustable portion.

10. The refrigerator/freezer ice bucket of claim 3, wherein the lower adjustable portion comprises a wall portion and a pair of wings disposed on opposite sides of the wall portion, each of the wings comprising a slot, and wherein the back wall of the dispenser interface comprises a slot facing the storage, wherein the fixed portion comprises a slot facing the storage on a wall of the fixed portion that is opposite the back wall of the dispenser interface, wherein the upper adjustable portion comprises a plurality of posts, the slots being configured to respectively receive the posts and allow the posts to move therein, thereby serving to pivot the lower adjustable portion from the position that is parallel to the opposite wall of the fixed portion to the position that is slanted upwardly away from the opposite wall of the fixed portion.

11. The refrigerator/freezer ice bucket of claim 3, wherein the lower adjustable portion comprises a wall portion and a pair of wings disposed on opposite sides of the wall portion, each of the wings comprising a post, and wherein the back wall of the dispenser interface comprises a post facing the storage, wherein the fixed portion comprises a post facing the storage on a wall of the fixed portion that is opposite the back wall of the dispenser interface, wherein the upper adjustable portion comprises a plurality of slots, the slots being configured to respectively receive the posts and allow the posts to move therein, thereby serving to pivot the lower adjustable portion from the position that is parallel to the opposite wall of the fixed portion to the position that is slanted upwardly away from the opposite wall of the fixed portion.

12. A refrigerator/freezer ice bucket, comprising:

a plurality of walls connected to each other, one or more of the walls being adjustable, one or more of the walls being fixed, one of the adjustable walls being configured to pivot from a position that is parallel to a portion of the fixed walls to a position in which the one pivoting adjustable wall is fixed to be slanted upwardly away from the portion of the fixed walls, thereby expanding a capacity of the plurality of walls to store ice cubes.

13. The refrigerator/freezer ice bucket of claim 12, wherein one of the fixed walls comprises a bottom floor that connects the adjustable walls to the fixed walls, the bottom floor being perpendicular to the portion of the fixed walls.

14. The refrigerator/freezer ice bucket of claim 12, wherein another one of the pivoting adjustable walls is configured to pivot while remaining parallel with the portion of the fixed walls.

15. The refrigerator/freezer ice bucket of claim 13, wherein another one of the pivoting adjustable walls is configured to pivot while remaining parallel with the portion of the fixed walls and perpendicular to the bottom floor.

16. The refrigerator/freezer ice bucket of claim 15, wherein the parallel pivoting adjustable walls comprise posts configured to fit slots of the slanting pivoting adjustable wall and the fixed walls.

17. A refrigerator/freezer ice bucket, comprising:

a dispenser interface configured to deliver ice cubes to an ice dispenser upon a request by a user for the ice cubes, the dispenser interface comprising a back wall; and storage configured to, with the back wall of the dispenser interface, store the ice cubes until the user request, the storage comprising a fixed portion and a hinged outer wall, the fixed portion being configured, with the back wall of the dispenser interface, to control a capacity of the storage to store the ice cubes by allowing the hinged outer wall to pivot.

18. The refrigerator/freezer ice bucket of claim 17, wherein the fixed portion is further configured, with the back wall of the dispenser interface, to allow the hinged outer wall to pivot to a position in which one or more portions of the hinged outer wall are slanted upwardly away from the fixed portion to increase the capacity of the storage.

19. The refrigerator/freezer ice bucket of claim 17, wherein the fixed portion and the back wall of the dispenser interface comprise slots through which posts of the hinged outer wall are allowed to move to cause the hinged outer wall to pivot, thereby adjusting the capacity of the storage.

20. The refrigerator/freezer ice bucket of claim 17, wherein the capacity of the storage increases as a distance between the fixed portion and the hinged outer wall increases.

* * * * *